US010744765B2

(12) United States Patent
Shimomura et al.

(10) Patent No.: US 10,744,765 B2
(45) Date of Patent: Aug. 18, 2020

(54) LIQUID DROPLET EJECTION HEAD AND LIQUID DROPLET EJECTION APPARATUS

(71) Applicant: Konica Minolta, Inc., Tokyo (JP)

(72) Inventors: Akito Shimomura, Hino (JP); Kusunoki Higashino, Musashino (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 16/331,017

(22) PCT Filed: Aug. 10, 2017

(86) PCT No.: PCT/JP2017/029098

§ 371 (c)(1),
(2) Date: Mar. 6, 2019

(87) PCT Pub. No.: WO2018/047576

PCT Pub. Date: Mar. 15, 2018

(65) Prior Publication Data

US 2019/0255846 A1 Aug. 22, 2019

(30) Foreign Application Priority Data

Sep. 12, 2016 (JP) ..... 2016-178011

(51) Int. Cl.
*B41J 2/14* (2006.01)
*B41J 2/045* (2006.01)
*B41J 2/16* (2006.01)

(52) U.S. Cl.
CPC ..... *B41J 2/14032* (2013.01); *B41J 2/045* (2013.01); *B41J 2/1433* (2013.01);
(Continued)

(58) Field of Classification Search
CPC .... B41J 2/14032; B41J 2/045; B41J 2/14209; B41J 2/14233; B41J 2/1433; B41J 2/162;
(Continued)

(56) References Cited

U.S. PATENT DOCUMENTS

2004/0017430 A1* 1/2004 Mizuyama et al. ..... 347/47
2007/0019042 A1 1/2007 Chung
(Continued)

FOREIGN PATENT DOCUMENTS

EP 1900528 A1 3/2008
JP 2011037257 B2 2/2011
(Continued)

OTHER PUBLICATIONS

European Search Report dated Aug. 27, 2019 for the corresponding EP Patent Application No. 17848520.7.
(Continued)

*Primary Examiner* — Juanita D Jackson
(74) *Attorney, Agent, or Firm* — Rankin, Hill & Clark LLP

(57) ABSTRACT

An object of the present invention is to provide a liquid droplet ejection head and a liquid droplet ejection apparatus in which viscosity resistance of a liquid to be ejected is reduced on an ejection side of a nozzle to prevent pointed-end ejection and to improve accuracy of an ejection angle. This object is achieved by the following. That is, a channel 28 having a volume to be changed by a pressure generation element and a nozzle 23 communicating with the channel 28 are included. The inside of the nozzle 23 has a conical portion 23*a* with a diameter becoming gradually smaller toward an outside, and a cylindrical portion 23*b* continuous with the conical portion 23*a* and communicating with the outside. A connecting part of the conical portion 23*a* to the cylindrical portion 23*b* has the same opening cross-sectional shape as a connecting part of the cylindrical portion 23*b* to the conical portion 23*a*. When an inner diameter of the cylindrical portion 23*b* is represented by $D_0$, the cylindrical portion 23*b* has an axial length of $0.1D_0$ to $0.3D_0$, and the conical portion 23*a* has an axial length of $0.6D_0$ or more and
(Continued)

a conical surface in which a generating line has an angle of 6 degrees or more and 15 degrees or less with respect to a nozzle central axis.

9 Claims, 8 Drawing Sheets

(52) U.S. Cl.
CPC ..... *B41J 2/14209* (2013.01); *B41J 2/14233* (2013.01); *B41J 2/162* (2013.01); *B41J 2/1628* (2013.01); *B41J 2/1629* (2013.01); *B41J 2/1632* (2013.01); *B41J 2002/14459* (2013.01); *B41J 2002/14475* (2013.01); *B41J 2202/21* (2013.01)

(58) Field of Classification Search
CPC ..... B41J 2/1628; B41J 2/1629; B41J 2/1632; B41J 2/14; B41J 2/135; B41J 2002/14475
See application file for complete search history.

(56) References Cited

U.S. PATENT DOCUMENTS

2007/0216726 A1 9/2007 Shimura
2010/0001095 A1 1/2010 Matsumoto
2012/0001986 A1* 1/2012 Kim ..... 347/47
2016/0136952 A1 5/2016 Ishikura

FOREIGN PATENT DOCUMENTS

JP 2013230676 A 11/2013
JP 2014113822 A 6/2014
JP 2015107556 A 6/2015
JP 2016007812 A 1/2016
WO 2007116699 A1 10/2007

OTHER PUBLICATIONS

International Search Report dated Oct. 24, 2017 filed in PCT/JP2017/029098.
PCT Written Opinion of the International Search Authority (Form PCT/ISA/237) filed in PCT/JP2017/029098, with PCT Translation of the Written Opinion of the International Search Authority dated Oct. 24, 2017.

* cited by examiner

LIQUID DROPLET EJECTION HEAD AND LIQUID DROPLET EJECTION APPARATUS

TECHNICAL FIELD

The present invention relates to a liquid droplet ejection head and a liquid droplet ejection apparatus, and specifically to a liquid droplet ejection head and a liquid droplet ejection apparatus in which viscosity resistance of a liquid to be ejected is reduced on an ejection side of a nozzle to prevent pointed-end ejection and to improve accuracy of an ejection angle.

BACKGROUND ART

Conventionally, as a liquid droplet ejection apparatus, an apparatus including a channel having a volume to be changed by a pressure generation element and a nozzle communicating with the channel has been proposed (Patent Literature 1).

In this liquid droplet ejection apparatus, when the volume of the channel is reduced by the pressure generation element, a liquid filled in the channel is ejected outward as a droplet through the nozzle. This liquid droplet is dropped onto a recording medium to form an image on the recording medium.

The viscosity of a liquid used in this liquid droplet ejection apparatus is 8 millipascal second or more. The nozzle has a first portion (funnel portion) defining a truncated conical space having a taper angle of 40 degrees or more on a side of a channel and a second portion having a shape (cylindrical shape) in which the cross-sectional area is substantially unchanged on a plane orthogonal to a nozzle direction on an ejection side.

CITATION LIST

Patent Literature

Patent Literature 1: JP 5428970 B2

SUMMARY OF INVENTION

Technical Problem

In a liquid droplet ejection apparatus, when a liquid droplet is ejected, a liquid droplet is not normally formed due to pointed-end ejection from a nozzle in some cases. In this case, the dropping amount (satellite amount) onto a position deviated from an original dropping position increases, which causes a large image quality deterioration at the time of image formation. In addition, ejection bending (deviation of ejection angle) at the time of ejecting a liquid droplet also causes a large image quality deterioration at the time of image formation.

The present inventors have found that a cause of such an image quality deterioration is the shape of the nozzle. In the above-described liquid droplet ejection apparatus (Patent Literature 1), it has been found that the cause of an image quality deterioration is the second portion (having a cylindrical shape in which the cross-sectional area is substantially unchanged on a plane orthogonal to a nozzle direction) on an ejection side of the nozzle.

Note that the above-described liquid droplet ejection apparatus (Patent Literature 1) is different from the present invention in ejecting a liquid having a high viscosity of 8 millipascal second or more, and therefore has a shape, an inner diameter, and a length of the nozzle largely different from the present invention. In addition, the nozzle of the above-described liquid droplet ejection apparatus (Patent Literature 1) has the first portion that is a funnel portion and the second portion having a cylindrical shape. However, the present invention intends to solve the problem in a nozzle only having the second portion in comparison with this liquid droplet ejection apparatus.

Therefore, the present invention is not achieved by simply miniaturizing (scaling down) the nozzle of the above-described liquid droplet ejection apparatus (Patent Literature 1).

Therefore, an object of the present invention is to provide a liquid droplet ejection head and a liquid droplet ejection apparatus in which viscosity resistance of a liquid to be ejected is reduced on an ejection side of a nozzle to prevent pointed-end ejection and to improve accuracy of an ejection angle.

Other objects of the present invention will become apparent from the following description.

Solution to Problem

The above problems are solved by the following inventions.

1.

A liquid droplet ejection head including:

a channel having a volume to be changed by a pressure generation element; and a nozzle communicating with the channel and being a through hole serving as a flow passage for a liquid to be ejected outward from an inside of the channel, in which an inside of the nozzle has a conical portion with a diameter becoming gradually smaller toward an outside, and a cylindrical portion continuous with the conical portion and communicating with the outside, a connecting part of the conical portion to the cylindrical portion has the same opening cross-sectional shape as a connecting part of the cylindrical portion to the conical portion, when an inner diameter of the cylindrical portion is represented by $D_0$, the cylindrical portion has an axial length of $0.1D_0$ to $0.3D_0$, and the conical portion has an axial length of $0.6D_0$ or more and a conical surface in which a generating line has an angle of 6 degrees or more and 15 degrees or less with respect to a nozzle central axis.

2.

The liquid droplet ejection head according to the above item 1, in which the nozzle has a conical or pyramidal portion in which a generating line has an angle of 15 degrees or more and 50 degrees or less with respect to the nozzle central axis on a side of the channel of the conical portion.

3.

The liquid droplet ejection head according to the above item 1 or 2, in which the nozzle is a through hole drilled in a nozzle plate made of a single crystal silicon material.

4.

The liquid droplet ejection head according to the above item 1, in which the nozzle is a through hole drilled in a nozzle plate made of a single crystal silicon material, and has a regular quadrangular pyramidal portion on a side of the channel of the conical portion, the regular quadrangular pyramidal portion is formed by anisotropic etching, and an angle of an inclined surface portion of the regular quadrangular pyramidal portion with respect to the nozzle central axis is an angle formed by (110) plane and (111) plane of a silicon crystal and is about 35.26 degrees.

5.

The liquid droplet ejection head according to any one of the above items 1 to 4, in which the cylindrical portion has a scallop strip.

6.

A liquid droplet ejection apparatus including:

the liquid droplet ejection head according to any one of the above items 1 to 5; and a drive signal generation unit that supplies a drive signal for changing the volume of the channel to the pressure generation element of the liquid droplet ejection head, in which the drive signal supplied by the drive signal generation unit is a signal for causing one nozzle to eject a plurality of liquid droplets within one pixel period.

Advantageous Effects of Invention

The present invention can provide a liquid droplet ejection head and a liquid droplet ejection apparatus in which viscosity resistance of a liquid to be ejected is reduced on an ejection side of a nozzle to prevent pointed-end ejection and to improve accuracy of an ejection angle.

DESCRIPTION OF EMBODIMENTS

Hereinafter, an embodiment of the present invention will be described in detail with reference to the drawings.

[Configuration of Liquid Droplet Ejection Apparatus]

The present invention is applied to a liquid droplet ejection head that expands and contracts the volume of a channel (pressure chamber) filled with a liquid such as an ink with a pressure generation element to eject the liquid via a nozzle, and is also applied to a liquid droplet ejection apparatus including this liquid droplet ejection head. In order to change the volume of the channel with the pressure generation element, a drive signal generation unit inputs a drive pulse to the pressure generation element.

Incidentally, in the present invention, a specific means for imparting ejection pressure to a liquid in the channel is not limited, and various known means can be adopted. In addition, the liquid droplet ejection apparatus to which the present invention is applied may be any one of various known types such as a line type and a serial type, and is not limited to any one of these types. However, in the following embodiments, the present invention will be described by mainly taking a line type liquid droplet ejection apparatus as an example.

Figure 1:
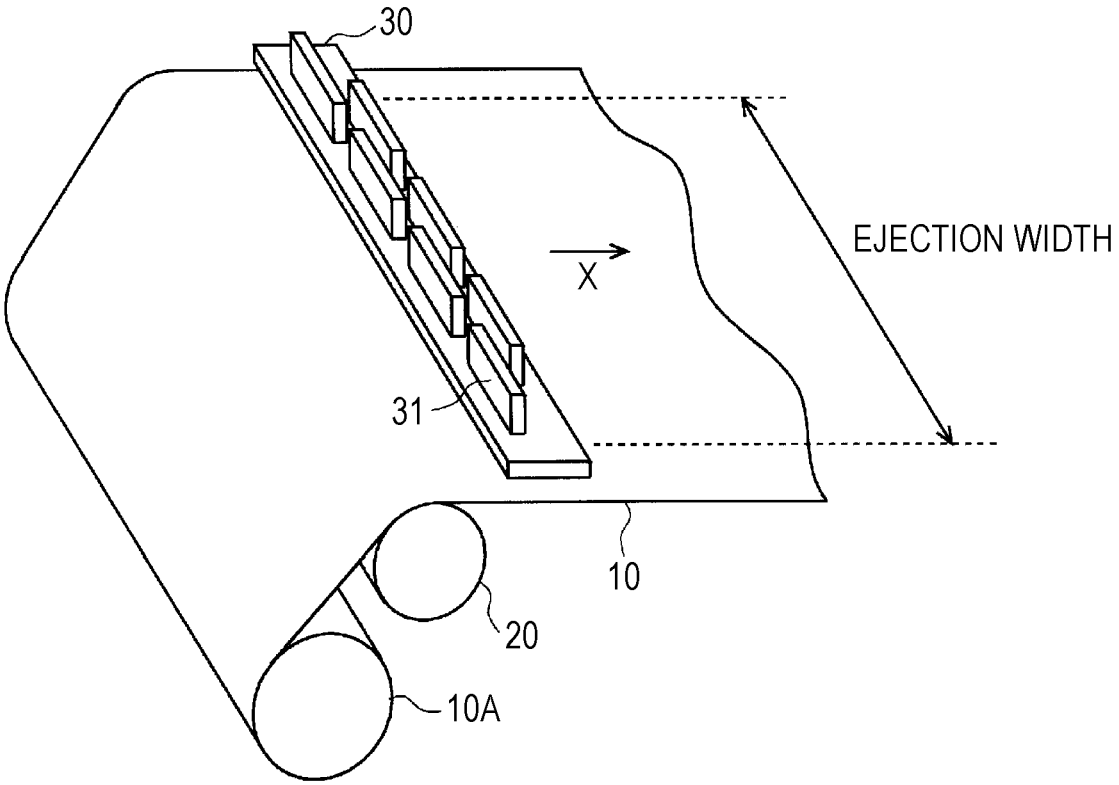
FIG. 1 is a perspective view illustrating a configuration of a main part of a line type liquid droplet ejection apparatus.

FIG. 1 is a perspective view illustrating a configuration of a main part of a line type liquid droplet ejection apparatus.

As illustrated in FIG. 1, this liquid droplet ejection apparatus includes a liquid droplet ejection head unit 30 including a plurality of liquid droplet ejection heads 31. The liquid droplet ejection head unit 30 is constituted by arranging the plurality of liquid droplet ejection heads 31 corresponding to an ejection width in a width direction of a recording medium. If a required ejection width can be secured by a single liquid droplet ejection head 31, only one liquid droplet ejection head 31 may be used. Each of the liquid droplet ejection heads 31 is disposed such that a nozzle surface side in a direction of ejecting a liquid droplet faces a recording surface of a recording medium 10. A liquid is supplied to each of the liquid droplet ejection heads 31 from a liquid tank (not illustrated) via a plurality of tubes.

Figure 2:
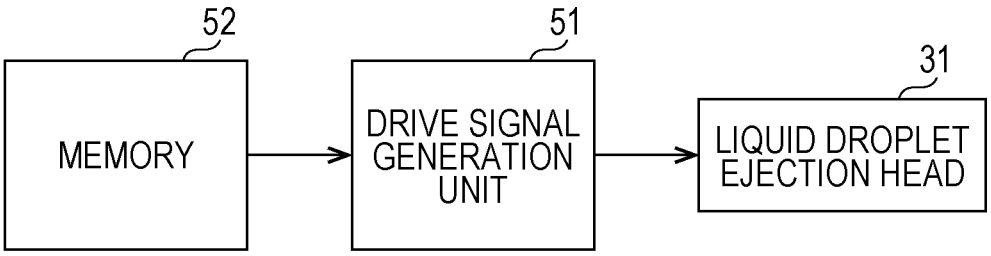
FIG. 2 is a block diagram illustrating an example of a drive signal generation unit.

FIG. 2 is a block diagram illustrating an example of a drive signal generation unit.

As illustrated in FIG. 2, a drive signal (drive pulse) is supplied to each of the liquid droplet ejection heads 31 from a drive signal generation unit 51. The drive signal generation unit 51 reads image data stored in a memory 52, generates a drive signal (drive pulse) based on the image data, and supplies the drive signal to each of the liquid droplet ejection heads 31.

In this liquid droplet ejection apparatus, as illustrated in FIG. 1, the recording medium 10 is long and fed out from an unwinding roll 10A in a direction of the arrow X in the drawing by a driving means (not illustrated) and is conveyed. Note that the direction of the arrow X also indicates a conveyance direction of the recording medium 10 in all of the following drawings. The long recording medium 10 is wound around and supported by a back roll 20 and is conveyed.

Then, a liquid droplet is ejected from each of the liquid droplet ejection heads 31 toward the recording medium 10, and an image is formed based on image data. The liquid droplet ejection head 31 records an image by conveyance of the recording medium 10 in a predetermined conveyance direction in a stationary state. During conveyance of the recording medium 10, a drive signal based on image data is supplied for each pixel period to eject a liquid droplet, and an image is formed. The recording medium 10 on which an image has been formed is dried and wound around a winding roll (not illustrated).

[Configuration of Liquid Droplet Ejection Head]

Figure 3A:
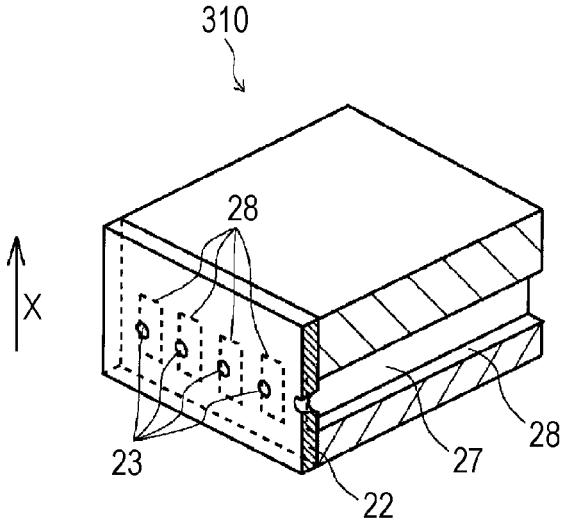
FIG. 3 is a view illustrating an example of a shear mode type liquid droplet ejection head.
Figure 3B:
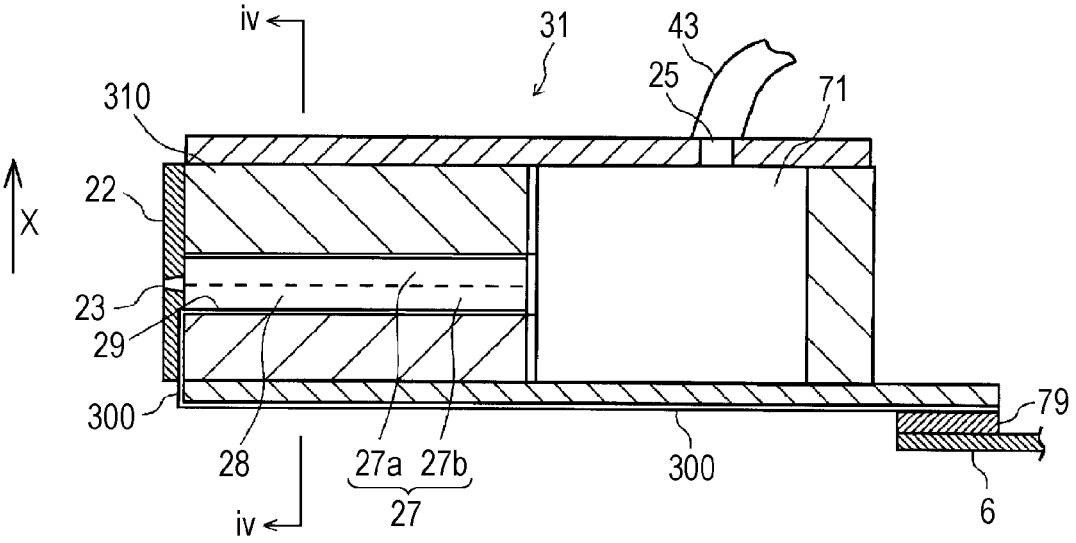

FIG. 3 is a view illustrating an example of the shear mode type liquid droplet ejection head 31 included in the liquid droplet ejection apparatus. FIG. 3A is a perspective view illustrating an external appearance thereof with a cross section, and FIG. 3B is a cross-sectional view as seen from a side.

In the drawing, the reference sign 310 indicates a head chip, and the reference sign 22 indicates a nozzle plate joined to a front surface of the head chip 310.

Incidentally, here, a surface onto which a liquid droplet is ejected from the head chip 310 is referred to as "front surface", and the surface opposite thereto is referred to as "rear surface". Outer surfaces located above and below with channels juxtaposed in the head chip 310 interposed therebetween are referred to as "upper surface" and "lower surface", respectively.

As illustrated in FIGS. 3A and 3B, the head chip 310 has a channel row in which a plurality of channels 28 partitioned by partition walls 27 is juxtaposed. The number of the channels 28 constituting the channel row is not limited at all. However, for example, the channel row is constituted by 512 channels 28.

Each of the partition walls 27 includes a piezoelectric element such as PZT that is an electric/mechanical converting means as the pressure generation element. In the present embodiment, each of the partition walls 27 includes two piezoelectric elements 27*a* and 27*b* having different polarization directions. However, the piezoelectric elements 27*a* and 27*b* only need to be included in at least a part of each of the partition walls 27, and only need to be disposed such that each of the partition walls 27 can be deformed.

A piezoelectric material used as the piezoelectric elements 27*a* and 27*b* is not particularly limited as long as causing deformation by application of a voltage, and a known piezoelectric material is used. The piezoelectric material may be a substrate made of an organic material, but is preferably a substrate made of a piezoelectric nonmetallic material. Examples of the substrate made of a piezoelectric nonmetallic material include a ceramic substrate formed through a steps such as molding or firing, and a substrate formed through a step such as coating or laminating Examples of the organic material include an organic polymer and a hybrid material of an organic polymer and an inorganic material.

Examples of the ceramic substrate include PZT ($PbZrO_3$—$PbTiO_3$) and third component-added PZT. Examples of the third component include $Pb(Mg_{1/3}Nb_{2/3})O_3$, $Pb(Mn_{1/3}Sb_{2/3})O_3$, and $Pb(Co_{1/3}Nb_{2/3})O_3$. Furthermore, the ceramic substrate can be formed using $BaTiO_3$, ZnO, $LiNbO_3$, $LiTaO_3$, or the like.

In the present embodiment, the two piezoelectric elements 27*a* and 27*b* are bonded so as to have polarization directions opposite to each other to be used. As a result, the amount of shear deformation is twice that in a case of using one piezoelectric element. In addition, in order to obtain the same amount of shear deformation, a driving voltage can be reduced to ½ or less.

On the front surface and the rear surface of the head chip 310, an opening on the front surface side and an opening on the rear surface side of each of the channels 28 are opened, respectively. Each of the channels 28 is a straight type channel in which the opening cross-sectional area and cross-sectional shape are substantially unchanged in a longitudinal direction from the opening on the rear surface side to the opening on the front surface side.

A front end of the channel 28 communicates with a nozzle 23 formed in a nozzle plate 22, and a rear end thereof is connected to a liquid tube 43 via a common liquid chamber 71 and a liquid supply port 25. The nozzle 23 is a through hole formed in the nozzle plate 22, and has a conical (tapered) portion with a diameter becoming gradually smaller toward an outside and a cylindrical (straight) portion continuous with the conical portion and communicating with the outside. The inner diameter of the nozzle 23 is much smaller than the inner dimensions of the channel 28, and a connecting part from the channel 28 to the nozzle 23 is stepped.

The nozzle plate 22 can also be made of a single crystal silicon material. In this case, the nozzle 23 can be formed by drilling a through hole in the single crystal silicon material. A hole can be drilled in the single crystal silicon material by dry etching (for example, reactive gas etching, reactive ion etching, reactive ion beam etching, ion beam etching, or reactive laser beam etching) or wet etching.

On the entire inner surface of each of the channels 28, an electrode 29 made of a metal film is formed in close contact therewith. The electrode 29 in the channel 28 is electrically connected to the drive signal generation unit 51 via a connection electrode 300, an anisotropic conductive film 79, and a flexible cable 6.

When a drive signal from the drive signal generation unit 51 is supplied to the electrode 29 in the channel 28, the partition wall 27 is bent and deformed with a joining surface between the piezoelectric elements 27*a* and 27*b* as a boundary. By such bending deformation of the partition wall 27, a pressure wave is generated in the channel 28, and pressure for ejection via the nozzle 23 is applied to the liquid in the channel 28.

FIG. 4 is a cross-sectional view taken along the line iv-iv in FIG. 3B for explaining an example of volume change of a channel.

Figure 4A:
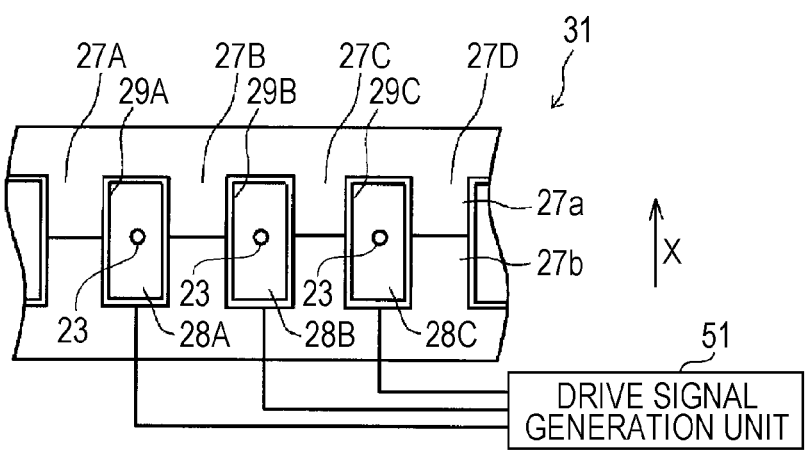
FIG. 4 is a cross-sectional view taken along the line iv-iv in FIG. 3B for explaining an example of volume change of a channel.

As illustrated in FIG. 4A, in a steady state in which a drive signal is not supplied to any of the electrodes 29A, 29B, and 29C in mutually adjacent channels 28A, 28B, and 28C, none of the partition walls 27A, 27B, 27C, and 27D are deformed.

Figure 4B:
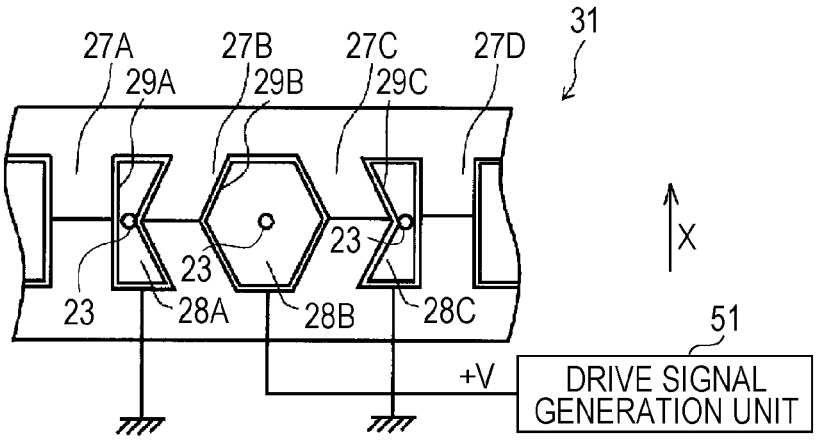

When the volume in the channel 28 is expanded, an expansion pulse (+V) is used as a drive signal. When the electrodes 29A and 29C of the channels 28A and 28C adjacent to the channel 28B to be expanded are grounded, and an expansion pulse (+V) from the drive signal generation unit 51 is applied to the electrode 29B of the channel 28B to be expanded, both the partition walls 27B and 27C of the channel 28B to be expanded cause shear deformation in a joining surface between the piezoelectric elements 27*a* and 27*b*. As a result, as illustrated in FIG. 4B, both the partition walls 27B and 27C are bent and deformed toward the outside of the channel 28B to expand the volume of the channel 28B to be expanded. Due to such bending deformation, a negative pressure wave is generated in the channel 28B, and the liquid in the nozzle 23 is drawn into the vicinity of a front end portion of the channel 28 behind the nozzle 23.

The expansion pulse is a pulse that expands the volume of the channel 28 from the volume in a steady state. The expansion pulse changes the voltage from a reference voltage GND to a crest value voltage +V, holds the crest value voltage +V for a predetermined time, and then changes the voltage again to the reference voltage GND.

Figure 4C:
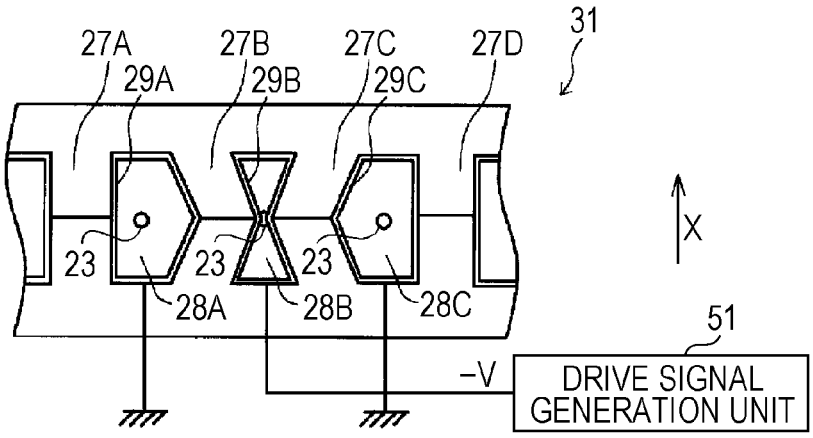

When the volume in the channel 28 is contracted, a contraction pulse (−V) is used as a drive signal. When the electrodes 29A and 29C of the channels 28A and 28C adjacent to the channel 28B to be contracted are grounded, and a contraction pulse (−V) from the drive signal generation unit 51 is applied to the electrode 29B of the channel 28B to be contracted, both the partition walls 27B and 27C of the channel 28B to be contracted cause shear deformation in a joining surface between the piezoelectric elements 27*a* and 27*b* in the opposite direction to that at the time of the expansion described above. As a result, as illustrated in FIG. 4C, both the partition walls 27B and 27C are bent and deformed toward the inside of the channel 28B to contract the volume of the channel 28B to be contracted. By this bending deformation, a positive pressure wave is generated in the channel 28B, and a liquid droplet is ejected via the corresponding nozzle 23.

The contraction pulse is a pulse that contracts the volume of the channel 28 from the volume in a steady state, changes the voltage from a reference voltage GND to a crest value voltage −V, holds the crest value voltage −V for a predetermined time, and then changes the voltage again to the reference voltage GND.

Incidentally, the pulse is a rectangular wave of a constant voltage crest value, and refers to a waveform in which both rise time and fall time between 10% and 90% of the voltage are within ½ of an acoustic length (AL), and preferably within ¼ thereof if the reference voltage GND is 0% and the crest value voltage is 100% in a case where the channel 28 has a straight shape as in the present embodiment. AL is an abbreviation for acoustic length, and refers to ½ of an acoustic resonance period of a pressure wave in the straight-shaped channel 28. AL is determined as a pulse width at which a flying speed of a liquid droplet ejected at the time of applying a rectangular wave drive signal to a drive electrode is maximized when the flying speed of the liquid droplet is measured, and a voltage value of the rectangular wave is fixed and a pulse width of the rectangular wave is changed. The pulse width is defined as time between the rise 10% from the reference voltage GND and the fall 10% from the crest value voltage. However, in the present invention, the drive signal is not limited to a rectangular wave, and may be a trapezoidal wave or the like.

In the channels 28A, 28B, and 28C illustrated in FIGS. 4A, 4B, and 4C, adjacent channels cannot be expanded or contracted at the same time, and therefore so-called three-cycle driving is preferably performed. In three-cycle driving, all the channels are divided into three groups, and adjacent channels are controlled in a time division manner. In addition, the present invention can also be applied to a so-called independent type liquid droplet ejection head in which an ejection channel and a channel (dummy channel) not performing ejection are alternately disposed. In the independent type liquid droplet ejection head, adjacent channels can be expanded or contracted at the same time, and therefore it is not necessary to perform three-cycle driving, and independent driving can be performed.

[Configuration (Shape) of Nozzle]

When a liquid droplet is ejected via the nozzle 23 in such a liquid droplet ejection head, if a liquid droplet is not formed normally due to pointed-end ejection from the nozzle 23, the amount (satellite amount) to a position deviated from an original dropping position may increase, or ejection bending (deviation of ejection angle) may occur at the time of ejecting the liquid droplet, which may result in a large image quality deterioration in a formed image.

Figure 5:
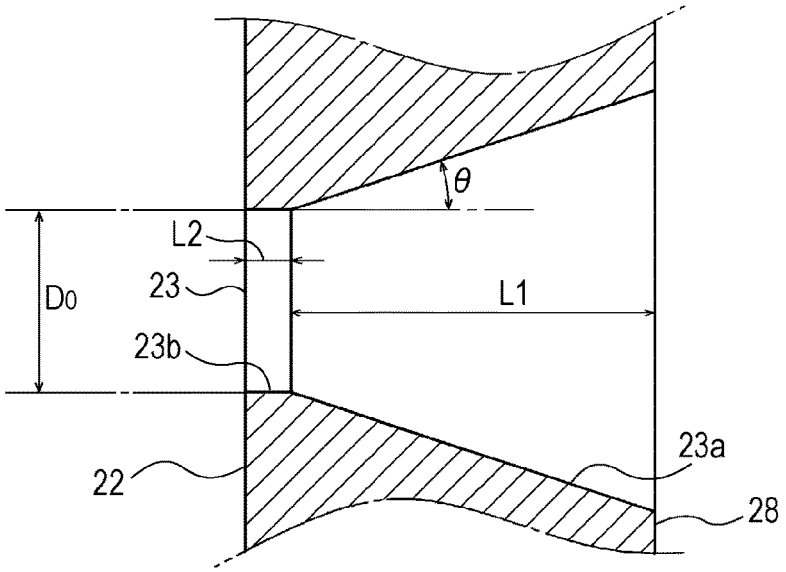
FIG. 5 is a longitudinal cross-sectional view illustrating the shape of a nozzle in a liquid droplet ejection head of an embodiment.

FIG. 5 is a longitudinal cross-sectional view illustrating the shape of a nozzle in this liquid droplet ejection head.

In this liquid droplet ejection head, as illustrated in FIG. 5, the inside of the nozzle 23 has a conical portion 23*a* with a diameter becoming gradually smaller toward an outside from a front end of the channel 28, and a cylindrical portion 23*b* continuous with the conical portion 23*a* and communicating with the outside on the front side. As a result, the internal volume of the nozzle 23 is increased to improve pumping capability, and pressure can be applied to a meniscus drawn into the nozzle 23 from a plurality of directions. Therefore, it is possible to reduce viscous resistance of the liquid to prevent pointed-end ejection.

A connecting part of the conical portion 23*a* to the cylindrical portion 23*b* has the same opening cross-sectional shape as a connecting part of the cylindrical portion 23*b* to the conical portion 23*a*, and the conical portion 23*a* and the cylindrical portion 23*b* are smoothly and continuously connected to each other without a step.

If the inner diameter of the cylindrical portion 23*b* is represented by $D_0$, the conical portion 23*a* has an axial length L1 of $0.6D_0$ or more. In addition, in the conical portion 23*a*, a generating line of a conical surface has an angle (taper angle) θ of 6 degrees or more and 15 degrees or less with respect to a nozzle central axis. A length L2 of the cylindrical portion 23*b* is $0.1D_0$ to $0.3D_0$.

Hereinafter, technical significance of setting the axial length L1 of the conical portion 23*a*, the angle (taper angle) θ of a generating line of a conical surface of the conical portion 23*a* with respect to a nozzle central axis, and the axial length L2 of the cylindrical portion 23*b* within the above ranges will be described with reference to FIGS. 6 to 10.

Figure 6:
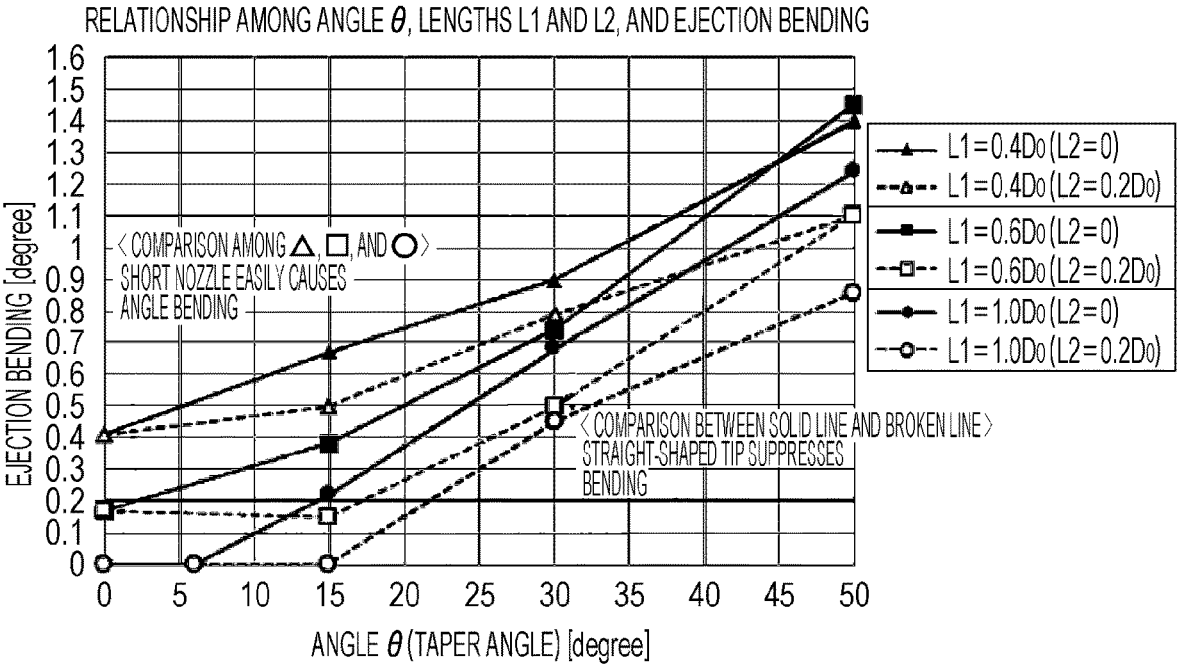
FIG. 6 is a graph illustrating a relationship between the axial length of a conical portion and ejection bending (deviation of ejection angle).

FIG. 6 is a graph illustrating a relationship between the axial length L1 of the conical portion 23*a* and ejection bending (deviation of ejection angle).

A reason why the axial length L1 of the conical portion 23*a* is set to $0.6D_0$ or more is that, as illustrated in FIG. 6, if the length L1 is shorter than $0.6D_0$, ejection bending is easily induced, and the ejection bending angle exceeds 0.2°. An ejection bending angle of 0.2° or less is desirable because an influence on image quality is small. FIG. 6 illustrates the following.

(1) Ejection bending angle when the length L1 is $0.4D_0$, the length L2 is 0, and the angle θ is 0 to 50 degrees (indicated by ▲)

(2) Ejection bending angle when the length L1 is $0.4D_0$, the length L2 is $0.2D_0$, and the angle θ is 0 to 50 degrees (indicated by Δ)

(3) Ejection bending angle when the length L1 is $0.6D_0$, the length L2 is 0, and the angle θ is 0 to 50 degrees (indicated by ■)

(4) Ejection bending angle when the length L1 is $0.6D_0$, the length L2 is $0.2D_0$, and the angle θ is 0 to 50 degrees (indicated by □)

(5) Ejection bending angle when the length L1 is $1.0D_0$, the length L2 is 0, and the angle θ is 0 to 50 degrees (indicated by ●)

(6) Ejection bending angle when the length L1 is $1.0D_0$, the length L2 is $0.2D_0$, and the angle θ is 0 to 50 degrees (indicated by ○)

FIG. 6 indicates that the ejection bending angle is 0.2° or less when the angle θ is 0 degrees to 15 degrees, the length L2 is $0.2D_0$, and the length L1 is $0.6D_0$ or more.

Figure 7:
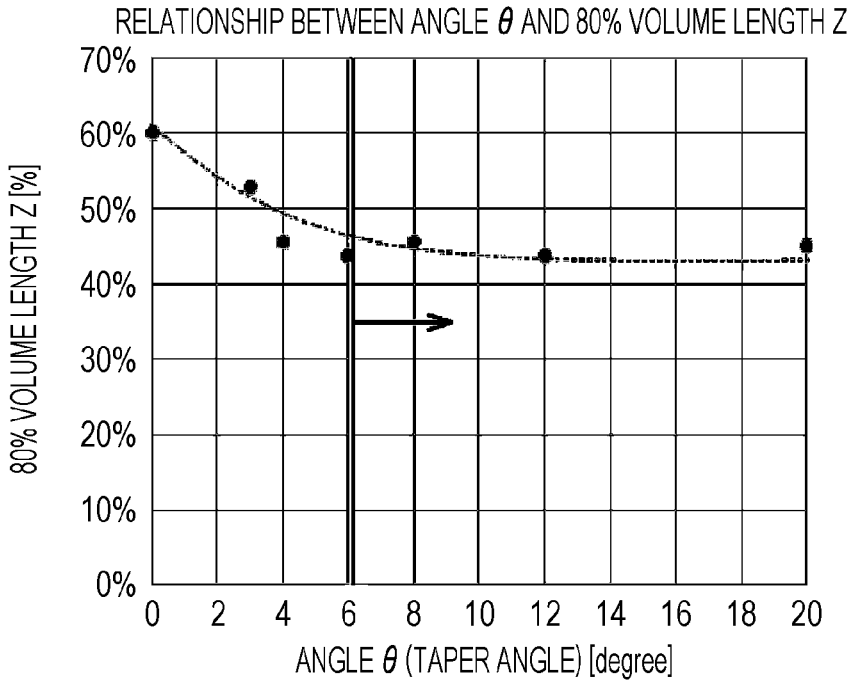
FIG. 7 is a graph illustrating a relationship between an angle of a generating line of a conical surface of the conical portion with respect to a nozzle central axis and the shape of a liquid droplet.

FIG. 7 is a graph illustrating a relationship between the angle θ of a generating line of a conical surface of the conical portion 23*a* with respect to a nozzle central axis and the shape of a liquid droplet.

A reason why the angle θ of a generating line of a conical surface of the conical portion 23*a* with respect to a nozzle central axis is set to 6 degrees or more is that the liquid forming an ejected liquid droplet concentrates on a tip side of the liquid droplet as illustrated in FIG. 7. The concentration of the liquid on the tip side of the liquid droplet in FIG. 7 is indicated by a distance Z from the tip of the liquid droplet to a position where 80% from the tip of the liquid droplet of the liquid forming the liquid droplet passes.

FIG. 8 is a schematic diagram illustrating the shape of a droplet to be ejected from the liquid droplet ejection head.

Figure 8A:
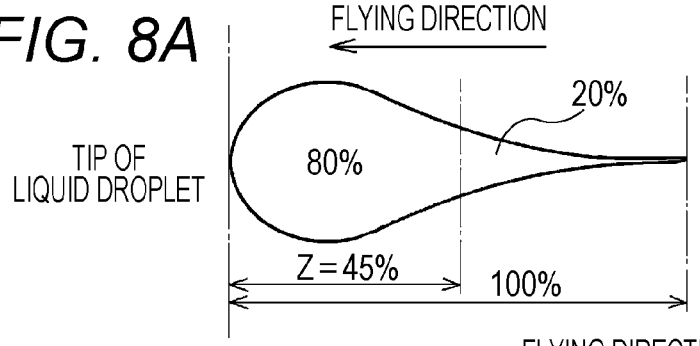
FIG. 8 is a schematic diagram illustrating the shape of a droplet to be ejected from the liquid droplet ejection head.
Figure 8B:
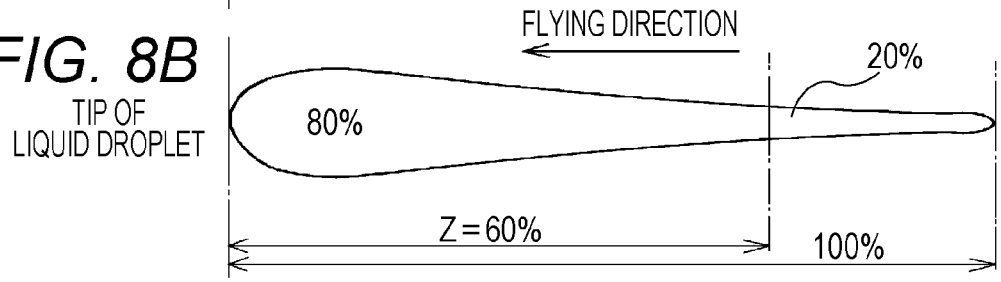

As illustrated in FIG. 8A, if the distance Z from the tip of a liquid droplet to a position where 80% from the tip of the liquid droplet of a liquid forming the liquid droplet passes is 45% or less with respect to the length (100%) of the entire liquid droplet, it can be said that the liquid in the liquid droplet sufficiently concentrates on the tip side of the liquid droplet. Meanwhile, as illustrated in FIG. 8B, if the distance Z from the tip of a liquid droplet to a position where 80% from the tip of the liquid droplet of a liquid forming the liquid droplet passes is more than 45% with respect to the length (100%) of the entire liquid droplet, it can be said that the liquid in the liquid droplet insufficiently concentrates on the tip side of the liquid droplet.

FIG. 9 is a schematic diagram illustrating the shape of a liquid droplet that has been ejected from the liquid droplet ejection head.

Figure 9A:
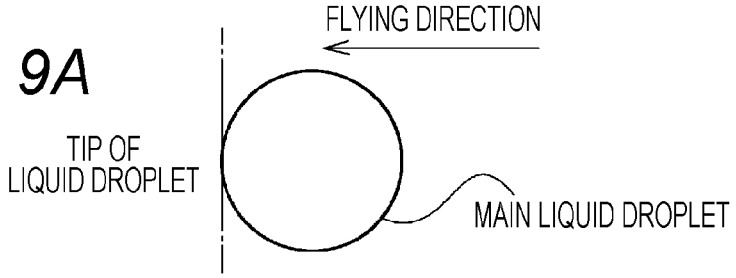
FIG. 9 is a schematic diagram illustrating the shape of a liquid droplet that has been ejected from the liquid droplet ejection head.
Figure 9B:
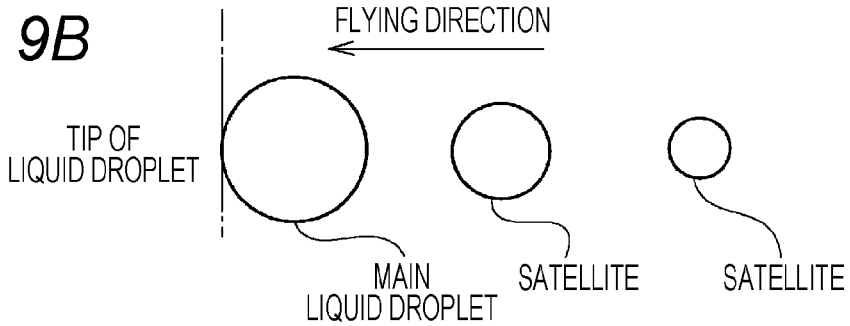

In a case where a liquid in a liquid droplet sufficiently concentrates on a tip side of the liquid droplet, as illustrated in FIG. 9A, in a course of the liquid droplet flying toward a recording medium, the entire liquid gathers to be one main liquid droplet and reaches the recording medium as it is. In this case, a favorable image without image quality deterioration is formed. Meanwhile, in a case where concentration of a liquid in a liquid droplet on a tip side of the liquid droplet is insufficient, as illustrated in FIG. 9B, in a course of the liquid droplet flying toward a recording medium, the liquid is divided into a plurality of liquid droplets including one main liquid droplet to become the main liquid droplet and a satellite, and the main droplet and the satellite reach the recording medium. In this case, the satellite reaches a place different from the main liquid droplet on the recording medium, and therefore image quality is deteriorated.

As illustrated in FIG. 7, in order to set the distance Z from the tip of a liquid droplet to a position where 80% from the tip of the liquid droplet of a liquid forming the liquid droplet passes to 45% or less with respect to the length (100%) of the entire liquid droplet, the angle θ of a generating line of a conical surface of the conical portion 23*a* with respect to a nozzle central axis needs to be 6 degrees or more.

As illustrated in FIG. 6, if the angle θ exceeds 15 degrees, the ejection bending angle exceeds 0.2° irrespective of the lengths L1 and L2. Therefore, the angle θ needs to be 15 degrees or less.

Figure 10:
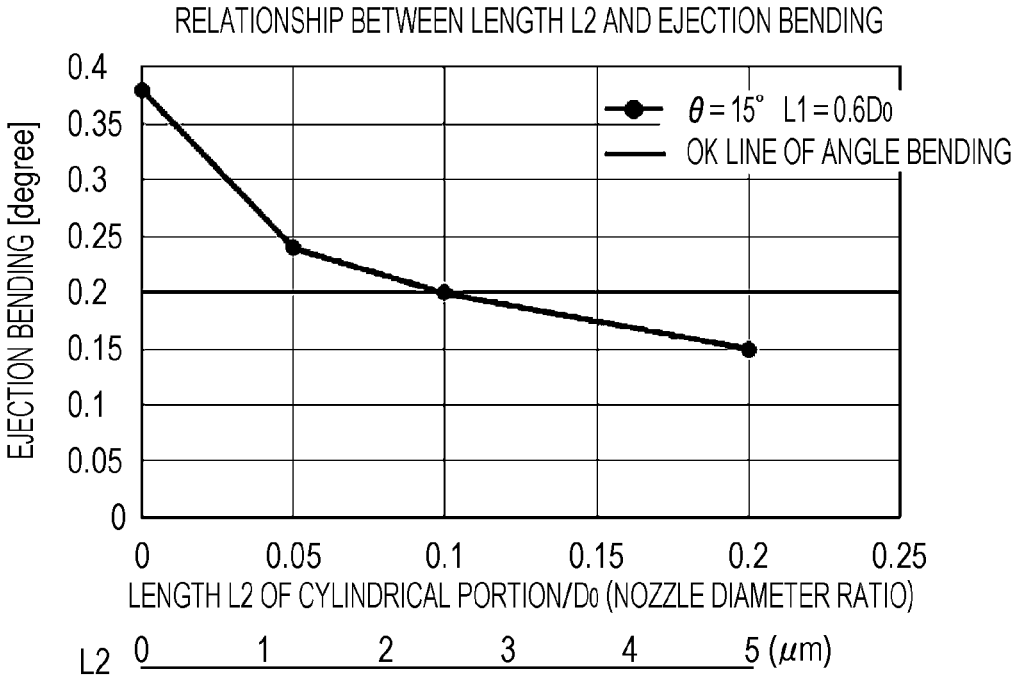
FIG. 10 is a graph illustrating a relationship between an axial length L2 of a cylindrical portion 23*b* and ejection bending (deviation of ejection angle).

FIG. 10 is a graph illustrating a relationship between the axial length L2 of the cylindrical portion 23*b* and ejection bending (deviation of ejection angle).

A reason why the length L2 of the cylindrical portion 23*b* is set to $0.1D_0$ or more is that, as illustrated in FIG. 10, if the length L2 is less than $0.1D_0$, the ejection bending angle exceeds 0.2°. Note that FIG. 10 illustrates a case where the length L1 is $0.6D_0$ and the angle θ is 15 degrees.

In FIG. 10, the actual dimensions of the length L2 of the cylindrical portion 23*b* in a case where the inner diameter $D_0$ of the cylindrical portion 23*b* is 25 μM are illustrated as reference dimensions. In this case, the length L2 of the cylindrical portion 23*b* is 2.5 μM or more and 7.5 μM or less.

A reason why the length L2 of the cylindrical portion 23*b* is set to $0.3D_0$ or less is that, as illustrated in the following Table 1, if the length L2 exceeds $0.3D_0$, the tail of an ejected liquid droplet is long, and a possibility of generation of a satellite is higher. Incidentally, in Table 1, the possibility of generation of a satellite is indicated by "○, Δ, or x" in a case where the angle θ is 6 degrees or 15 degrees. "○" indicates that the possibility of generation of a satellite is sufficiently low. "Δ" indicates that a satellite may be generated. "x" indicates that the possibility of generation of a satellite is high.

TABLE 1

| Length L2 of cylindrical portion/$D_0$ | 0 | 0.1 | 0.2 | 0.3 | 0.5 |
|---|---|---|---|---|---|
| θ = 6° | ○ | ○ | ○ | Δ | x |
| θ = 15° | ○ | ○ | ○ | ○ | Δ |

As described above, the technical significance is clarified by FIG. 6 for the lower limit ($0.6D_0$ or more) of the axial length L1 of the conical portion 23*a*. In addition, the technical significance is clarified by FIGS. 7 and 6 for the lower limit (6° or more) of the angle (taper angle) θ of a generating line of a conical surface of the conical portion 23*a* with respect to a nozzle central axis and the upper limit (15° or less) thereof, respectively. Furthermore, the technical significance is clarified by FIG. 10 and Table 1 for the lower limit ($0.1D_0$ or more) of the axial length L2 of the cylindrical portion 23*b* and the upper limit ($0.3D_0$ or less) thereof, respectively.

In this manner, in the liquid droplet ejection head of the present invention, the inside of the nozzle 23 has the conical portion 23*a* and the cylindrical portion 23*b*. Therefore, pumping capability of the head is improved, pointed-end ejection is prevented, and ejection bending (deviation of ejection angle) at the time of ejecting a liquid droplet is reduced to form a favorable image without image quality deterioration.

In addition, in this liquid droplet ejection head, by disposing the cylindrical portion 23*b* on a front end side of the nozzle 23, dimensional accuracy of the inner diameter of the nozzle 23 can be improved particularly in a case where the nozzle plate 22 is made of a silicon material. If the conical portion 23*a* reaches a surface (front surface) of the nozzle plate 22 without disposing the cylindrical portion 23*b*, a slight inclination of the conical portion 23*a* and a slight error of the taper angle affect the inner diameter dimensions of a front end opening of the nozzle 23, and it is difficult to maintain the accuracy of the inner diameter dimensions.

Another Embodiment of Liquid Droplet Ejection Head

Figure 11:
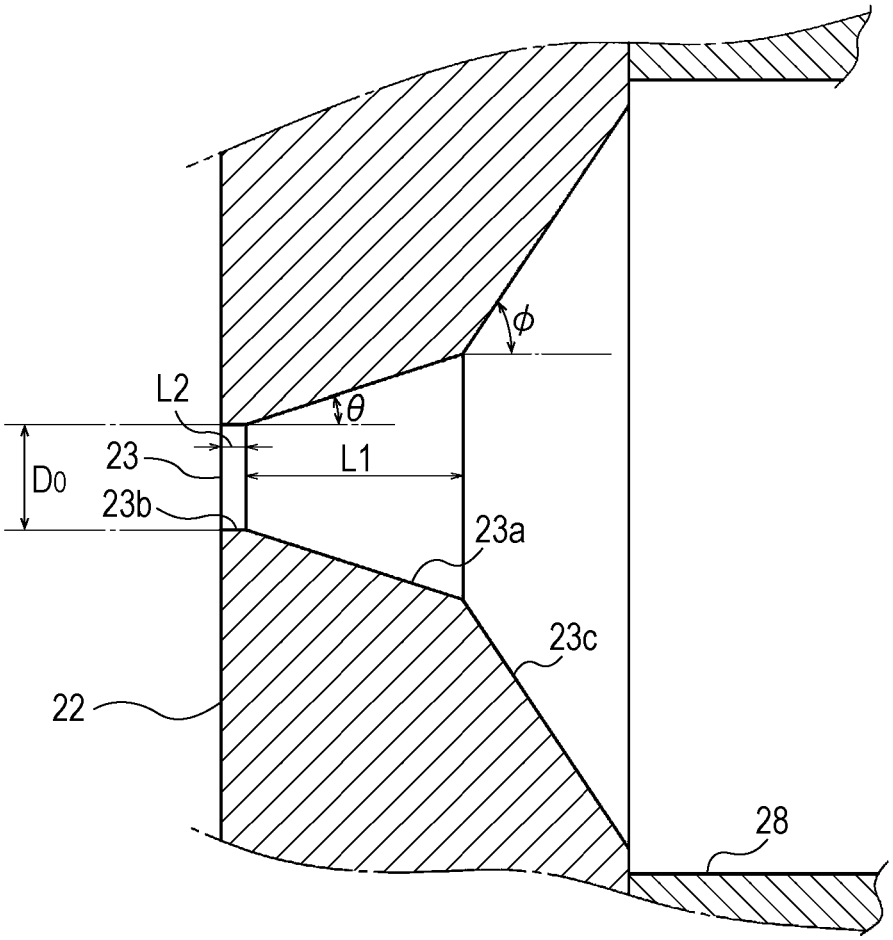
FIG. 11 is a longitudinal cross-sectional view illustrating another example of the shape of the nozzle in the liquid droplet ejection head of the embodiment.

FIG. 11 is a longitudinal cross-sectional view illustrating another example of the shape of the nozzle 23 in the liquid droplet ejection head of the embodiment.

As illustrated in FIG. 11, the nozzle 23 may have a conical or pyramidal portion (funnel portion) 23*c* between a front end of the channel 28 and a rear end portion of the conical portion 23*a*. This conical or pyramidal portion 23*c* has a diameter becoming gradually smaller from a front end of the channel 28 to the front end of the conical or pyramidal portion 23*c* to smoothly connect the channel 28 and the conical portion 23*a* to each other. In this conical or pyramidal portion 23*c*, an angle φ of a generating line with respect to a nozzle central axis is preferably 15 degrees or more and 50 degrees or less.

In a case where the nozzle 23 is a through hole drilled in the nozzle plate 22 made of a single crystal silicon material, the conical or pyramidal portion 23*c* between the channel 28 and the conical portion 23*a* may be a regular quadrangular pyramidal portion 23*c*. This regular quadrangular pyramidal portion 23*c* can be formed by anisotropic etching of a single crystal silicon material using (110) plane and (111) plane of a silicon crystal. Therefore, in the regular quadrangular pyramidal portion 23*c*, an angle φ of an inclined plane portion with respect to a nozzle central axis is about 35.26 degrees which is an angle formed by (110) plane and (111) plane of a silicon crystal.

Furthermore, a scallop strip may be present on an inner surface of the cylindrical portion 23*b* of the nozzle 23. The scallop strip present on the inner surface of the cylindrical portion 23*b* of the nozzle 23 can be formed by a scalloping process. The scalloping process is a process of repeating a masking step and an etching step in a dry etching process of a single crystal silicon material to drill a hole having a desired shape. In this scalloping process, a masking position changes for each step, and a scallop strip formed of fine unevenness is thereby formed. Since such a scallop strip is formed of fine unevenness, the inner surface of the cylindrical portion 23*b* can be regarded as a flat surface even if the scallop strip is present, and the scallop strip does not affect an action of the cylindrical portion 23*b*.

Another Embodiment (1) of Liquid Droplet Ejection Apparatus

In the liquid droplet ejection apparatus of the present invention, a drive signal supplied by the drive signal generation unit 51 may be a signal (multi-drop signal) for causing each nozzle 23 to eject a plurality of liquid droplets within one pixel period.

In the liquid droplet ejection apparatus of the present invention, by inclusion of the conical portion 23*a*, the internal volume of the nozzle 23 is increased to improve pumping capability, pressure can be applied to a meniscus drawn into the nozzle 23 from a plurality of directions, and viscous resistance of a liquid can be reduced. Therefore, the present invention is particularly effective in a case where each nozzle 23 ejects a plurality of liquid droplets within one pixel period to make so-called gradation expression possible, and is highly useful in such a case.

Another Embodiment (2) of Liquid Droplet Ejection Apparatus

In the above description, the line type liquid droplet ejection apparatus has been described. However, the present invention is not limited thereto, and can also be preferably applied to a serial type (also referred to as a shuttle type) liquid droplet ejection apparatus that performs recording while performing reciprocating motion (shuttle motion) in a direction orthogonal to a conveyance direction of a recording medium.

In addition, in the above description, the case where the liquid droplet ejection head included in the liquid droplet ejection apparatus is a shear mode type has been described. However, in the present invention, the distortion form of the piezoelectric element in the liquid droplet ejection head is not particularly limited, and the present invention can be preferably applied to, for example, a bend mode type or a longitudinal mode (also referred to as a push mode or a direct mode) type in addition to the shear mode type. The present invention can be applied to various liquid droplet ejection apparatuses regardless of the distortion form of the piezoelectric element, the volume/shape of the channel, and the like as long as the liquid droplet ejection apparatuses eject a liquid from a nozzle by changing the volume of a channel filled with the liquid.

In addition, the present invention can also be applied to a so-called independent type liquid droplet ejection head. In the independent type liquid droplet ejection head, adjacent channels can be expanded or contracted at the same time, and independent driving can be performed.

Another Embodiment (3) of Liquid Droplet Ejection Apparatus

Figure 12A:
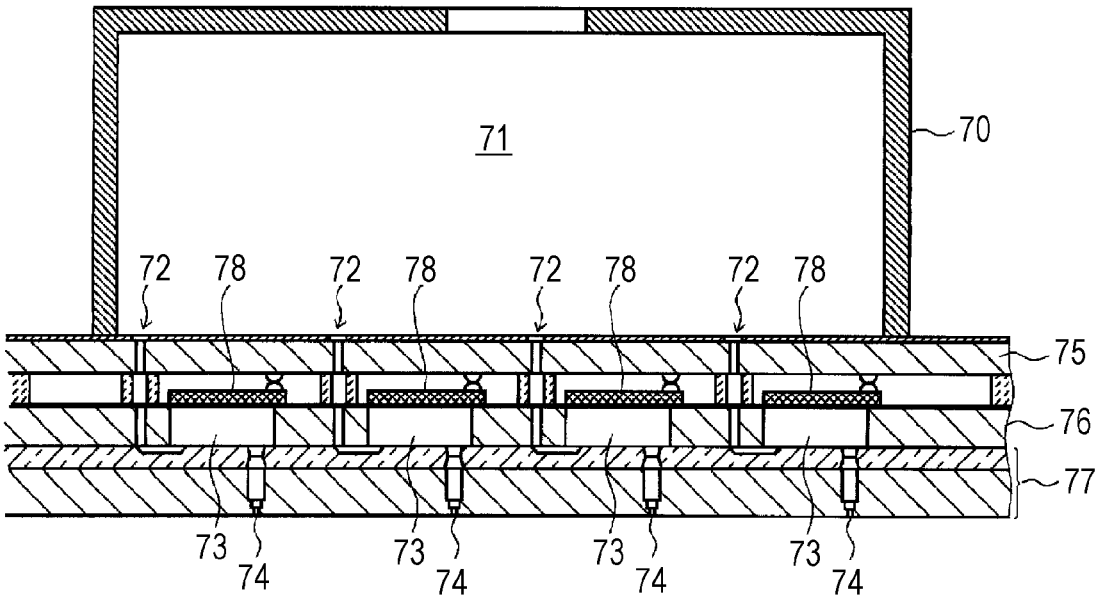
FIG. 12 is a view illustrating an example of a so-called MEMS type liquid droplet ejection head.
Figure 12B:
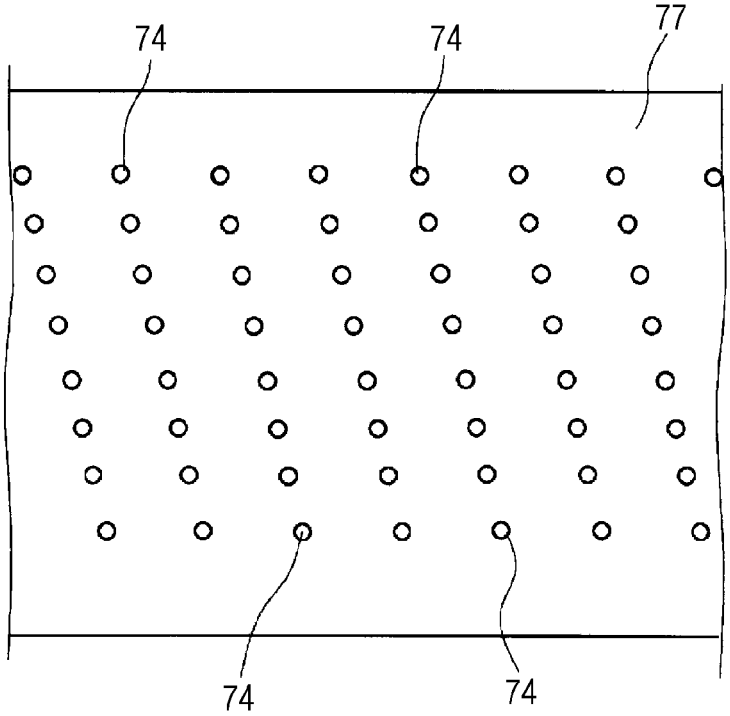

FIG. 12 is a view illustrating an example of a so-called MEMS type liquid droplet ejection head in which a plurality of channels is two-dimensionally disposed. FIG. 12A is a cross-sectional view as seen from a side, and FIG. 12B is a bottom view of a nozzle surface as seen from a bottom surface.

The present invention can also be applied to a so-called MEMS liquid droplet ejection head. As illustrated in FIG. 12A, the so-called MEMS type liquid droplet ejection head has a liquid manifold 70 constituting the common liquid chamber 71. An open bottom portion of the liquid manifold 70 is covered by an upper substrate 75. The inside of the common liquid chamber 71 is filled with a liquid supplied.

Below the upper substrate 75, a lower substrate 76 is disposed parallel to the upper substrate 75. Between the upper substrate 75 and the lower substrate 76, a plurality of piezoelectric elements 78 is disposed. A drive signal is applied to these piezoelectric elements 78 via a wiring pattern (not illustrated) formed on a lower surface of the upper substrate 75. A plurality of channels 73 is disposed corresponding to these piezoelectric elements 78, respectively. These channels 73 are through holes formed in the lower substrate 76. Upper portions of the channels 73 are covered by the corresponding piezoelectric element 78, and bottom portions thereof are covered by a nozzle plate 77. The nozzle plate 77 is bonded to a lower surface of the lower substrate 76.

A bottom portion of each of the channels 73 communicates with the common liquid chamber 71 via an injection hole 72 formed through the upper substrate 75 and the lower substrate 76 corresponding to each of the channels 73 and a groove formed on an upper surface of the nozzle plate 77. A liquid in the common liquid chamber 71 is supplied into each of the channels 73 via the injection hole 72 and the groove formed on the upper surface of the nozzle plate 77. In addition, each of the channels 73 communicates with the outside (lower side) via a nozzle 74 formed in the nozzle plate 77 corresponding to each of the channels 73.

In this liquid droplet ejection head, when a drive signal is applied to the piezoelectric element 78, the volume of the corresponding channel 73 is changed (expanded and contracted), and the liquid in the channel 73 is ejected outward (downward) via the nozzle 74.

In this liquid droplet ejection head, as illustrated in FIG. 12B, the nozzles 74 are two-dimensionally disposed on a lower surface of the nozzle plate 77. The piezoelectric elements 78 are also two-dimensionally disposed corresponding to the nozzles 74.

In each of the above-described embodiments, the liquid droplet ejection apparatus may eject a liquid other than an ink. In addition, the liquid referred to herein only needs to be a material that can be ejected from the liquid droplet ejection apparatus. For example, the liquid only needs to be a substance in a liquid phase, and includes a fluid material such as a liquid material having high or low viscosity, sol, gel water, another inorganic solvent, an organic solvent, a solution, a liquid resin, or a liquid metal (metallic melt). In addition, the liquid includes not only a liquid as one state of a substance but also a substance in which particles of a functional material formed of a solid material such as a pigment or metal particles are dissolved, dispersed, or mixed in a solvent, and the like. Representative examples of the liquid include an ink and a liquid crystal as described in the above embodiments. Here, the "ink" includes various kinds of liquid compositions such as a general water-based ink and oil-based ink, a gel ink, and a hot melt ink. Specific examples of the liquid droplet ejection apparatus include a liquid droplet ejection apparatus that ejects a liquid containing a material such as an electrode material or a color material used for manufacturing, for example, a liquid crystal display, an electroluminescence (EL) display, a surface emitting display, or a color filter in a dispersed or dissolved form in a form of a liquid droplet. In addition, the liquid droplet ejection apparatus may be a liquid droplet ejection apparatus that ejects a bioorganic material used for manufacturing a biochip, a liquid droplet ejection apparatus that ejects a liquid serving as a sample used as a precision pipette, or the like. Furthermore, the liquid droplet ejection apparatus may be a liquid droplet ejection apparatus that ejects a lubricating oil at a pinpoint to a precision machine such as a watch or a camera, or a liquid droplet ejection apparatus that ejects a transparent resin liquid such as an ultraviolet curable resin onto a substrate in order to form a hemispherical lens (optical lens) used for an optical communication element or the like. In addition, the liquid droplet ejection apparatus may be a liquid droplet ejection apparatus that ejects an etching liquid such as an acid or an alkali for etching a substrate or the like.

As described above, according to the above-described liquid droplet ejection head and liquid droplet ejection apparatus, by reducing viscosity resistance of a liquid to be ejected on an ejection side of the nozzle 74, pointed-end ejection is prevented, and accuracy of an ejection angle is improved.

REFERENCE SIGNS LIST

22 Nozzle plate
23 Nozzle
23*a* Conical portion
23*b* Cylindrical portion
27 Partition wall
27*a* Piezoelectric element
27*b* Piezoelectric element
28 Channel
29 Electrode
31 Liquid droplet ejection head
300 Connection electrode
310 Head chip
52 Memory
51 Drive signal generation unit
6 Flexible cable
74 Nozzle

The invention claimed is:

1. A liquid droplet ejection head comprising:
a channel having a volume to be changed by a pressure generation element; and
a nozzle communicating with the channel and being a through hole serving as a flow passage for a liquid to be ejected outward from an inside of the channel, wherein
an inside of the nozzle has a conical portion with a diameter becoming gradually smaller toward an outside, and a cylindrical portion continuous with the conical portion and communicating with the outside,
a connecting part of the conical portion to the cylindrical portion has the same opening cross-sectional shape as a connecting part of the cylindrical portion to the conical portion,
when an inner diameter of the cylindrical portion is represented by $D_0$, the cylindrical portion has an axial length of $0.1D_0$ to $0.3D_0$, and
the conical portion has an axial length of $0.6D_0$ or more and a conical surface in which a generating line has an angle of 6 degrees to 15 degrees with respect to a nozzle central axis.

2. The liquid droplet ejection head according to claim 1, wherein the nozzle further has, between the channel and the conical portion in an axial direction of the conical portion, a funnel portion in which a generating line has an angle of 15 degrees to 50 degrees with respect to the nozzle central axis, the funnel portion having a shape selected from a group consisting of a conical shape and a pyramidal shape.

3. The liquid droplet ejection head according to claim 2, wherein the nozzle is the through hole drilled in a nozzle plate made of a single crystal silicon material.

4. A liquid droplet ejection apparatus comprising:
the liquid droplet ejection head according to claim 2; and
a drive signal generator that supplies a drive signal for changing a volume of the channel to the pressure generation element of the liquid droplet ejection head, wherein
the drive signal supplied by the drive signal generator is a signal for causing one nozzle to eject a plurality of liquid droplets within one pixel period.

5. The liquid droplet ejection head according to claim 1, wherein the nozzle is the through hole drilled in a nozzle plate made of a single crystal silicon material.

6. A liquid droplet ejection apparatus comprising:
the liquid droplet ejection head according to claim 5; and
a drive signal generator that supplies a drive signal for changing a volume of the channel to the pressure generation element of the liquid droplet ejection head, wherein
the drive signal supplied by the drive signal generator is a signal for causing one nozzle to eject a plurality of liquid droplets within one pixel period.

7. The liquid droplet ejection head according to claim 1, wherein
the nozzle is the through hole drilled in a nozzle plate made of a single crystal silicon material, and has a regular quadrangular pyramidal portion on a side of the channel of the conical portion,
the regular quadrangular pyramidal portion is formed by anisotropic etching, and
an angle of an inclined surface portion of the regular quadrangular pyramidal portion with respect to the nozzle central axis is an angle formed by (110) plane and (111) plane of a silicon crystal and is about 35.26 degrees.

8. A liquid droplet ejection apparatus comprising:
the liquid droplet ejection head according to claim 7; and
a drive signal generator that supplies a drive signal for changing a volume of the channel to the pressure generation element of the liquid droplet ejection head, wherein
the drive signal supplied by the drive signal generator is a signal for causing one nozzle to eject a plurality of liquid droplets within one pixel period.

9. A liquid droplet ejection apparatus comprising:

the liquid droplet ejection head according to claim 1; and a drive signal generator that supplies a drive signal for changing a volume of the channel to the pressure generation element of the liquid droplet ejection head, wherein the drive signal supplied by the drive signal generator is a signal for causing one nozzle to eject a plurality of liquid droplets within one pixel period.

* * * * *